US007527245B2

(12) United States Patent
Lesko

(10) Patent No.: US 7,527,245 B2
(45) Date of Patent: May 5, 2009

(54) ELECTRIC DRAWWORKS FOR A DRILLING RIG

(76) Inventor: Gerald Lesko, 4807-68 Avenue, Edmonton, Alberta (CA) T6B 2N2

( * ) Notice: Subject to any disclaimer, the term of this patent is extended or adjusted under 35 U.S.C. 154(b) by 166 days.

(21) Appl. No.: 11/268,258

(22) Filed: Nov. 7, 2005

(65) Prior Publication Data

US 2006/0249719 A1 Nov. 9, 2006

(30) Foreign Application Priority Data

Apr. 29, 2005 (CA) ..... 2505989

(51) Int. Cl.
*B66D 1/22* (2006.01)

(52) U.S. Cl. ..... 254/344; 254/358

(58) Field of Classification Search ..... 254/342, 254/344, 378, 362, 363, 358
See application file for complete search history.

(56) References Cited

U.S. PATENT DOCUMENTS

| | | | | | |
|---|---|---|---|---|---|
| 1,953,865 | A | * | 4/1934 | Penick et al. | 254/297 |
| 1,998,013 | A | * | 4/1935 | Greve | 475/300 |
| 2,351,654 | A | * | 6/1944 | Anderson | 254/344 |
| 2,505,088 | A | | 4/1950 | Athy | |
| 2,950,086 | A | * | 8/1960 | Abraham | 254/270 |
| 3,738,614 | A | * | 6/1973 | Peterson | 254/358 |
| 4,177,973 | A | * | 12/1979 | Miller et al. | 254/276 |
| 4,227,680 | A | * | 10/1980 | Hrescak | 254/344 |
| 4,328,954 | A | * | 5/1982 | Logus | 254/344 |
| 4,438,904 | A | | 3/1984 | White | |
| 4,520,900 | A | * | 6/1985 | Orgeron | 182/238 |
| 4,616,735 | A | * | 10/1986 | Orgeron | 182/238 |
| 5,211,124 | A | * | 5/1993 | Reiser | 114/44 |
| 5,425,435 | A | * | 6/1995 | Gregory | 188/77 W |
| 5,586,617 | A | * | 12/1996 | England et al. | 182/238 |
| 5,842,684 | A | * | 12/1998 | Aho | 254/344 |
| 5,921,529 | A | * | 7/1999 | Wilson et al. | 254/346 |
| 6,182,945 | B1 | | 2/2001 | Dyer et al. | |
| 6,827,120 | B2 | * | 12/2004 | Last | 160/133 |
| 7,210,670 | B2 | * | 5/2007 | Franks | 254/294 |
| 7,232,113 | B2 | * | 6/2007 | Heinrichs et al. | 254/342 |

FOREIGN PATENT DOCUMENTS

| | | |
|---|---|---|
| CA | 1153063 | 8/1983 |
| CA | 1285401 | 7/1991 |
| CA | 2114807 | 10/1994 |
| CA | 2310615 | 7/1999 |
| CA | 2372327 | 11/2000 |

* cited by examiner

*Primary Examiner*—Emmanuel M Marcelo
(74) *Attorney, Agent, or Firm*—Dinsmore & Shohl LLP

(57) ABSTRACT

A cable drawworks for a drilling rig has an electric motor and a primary drive transmission which connects the motor to a drum shaft that passes through the hub of a cable drum. The drum shaft is rotatably mounted on the drawworks frame whereas the cable drum is rotatably mounted on the drum shaft. The drum shaft connects to a secondary drive transmission that connects the drum shaft to the cable drum. The secondary drive transmission has a planetary gear transmission set. Each end of the cable drum has a brake drum and a brake band wrapped around thereon. A brake actuating system is used to selectively tighten the bands and includes an equalization linkage system resulting in equal braking forces being applied to each brake drum. The simplified cable drawworks system is compact enough to be mounted on the drilling rig floor and eliminates the need for liquid cooling of the braking mechanism.

12 Claims, 9 Drawing Sheets

ELECTRIC DRAWWORKS FOR A DRILLING RIG

FIELD OF THE INVENTION

The present invention relates to the field of drawworks mechanisms for use in raising and lowering traveling blocks within drilling rigs.

BACKGROUND OF THE INVENTION

Drawworks mechanisms have been used in drilling rigs for decades. Drawworks are, typically, motor-driven drums used to reel in or pay out a cable used on the drilling rig to raise or lower a traveling block within the rig. The cable will typically be used with pulleys and pulley blocks attached to the top of the rig and the traveling block, respectively. The traveling block is used for tripping pipe in and out a drill string, as well known to those skilled in the art. Various methods and devices have been developed for this purpose. However, conventional arrangements require excessive physical space to house such a mechanism on a drilling rig platform.

It is, therefore, desirable to have a drawworks mechanism that is compact enough so that it may be located directly on a drilling platform yet having sufficient power and braking ability to safely reel in and pay out cable for raising and lowering a traveling block within a drilling rig.

SUMMARY OF THE INVENTION

One embodiment of the present invention involves a drawworks mechanism for a drilling rig that overcomes the shortcomings identified in the prior art. The drawworks mechanism comprises a frame that has a footprint compact enough to allow it to be located on a drilling rig platform. The frame comprises at least a floor member having opposing sidewall members.

The frame has a motor mounted on it with a drive shaft, preferably, configured in a horizontal position. A drum shaft having first and second ends is rotatably mounted on the frame sidewalls such that it is substantially parallel to the motor's drive shaft. A primary drive means couples the drive shaft to the first end of the drum shaft. The primary drive means may be any suitable coupling mechanism such as a chain and sprockets, a belt and pulleys, a set of intermeshed gears or any other means as well known to those skilled in the art. Preferably, the primary drive means is a triplex chain and sprockets system having a gear ratio in the range of 1.5:1 to 2:1. A cable drum is rotatably mounted on the drum shaft and is concentrically disposed about the drum shaft between the first and second ends. In one embodiment, a secondary drive means can directly and rotatably couple the drum shaft to the cable drum on the second end side of the drum shaft. Preferably, the secondary drive means is a planetary gear transmission having a sun gear, a ring gear and a planetary gear set as well known to those skilled in the art. The sun gear is disposed about the second end of the drum shaft whereas the ring gear is operatively coupled to the frame and the planetary gear set is operatively coupled to the cable drum. In this configuration, when the drum shaft rotates, the sun gear rotates the planetary gear set that, in turn, rotates the cable drum. In the preferred embodiment, the planetary gear transmission has a 4:1 gear ratio such that the overall gear ratio from the motor to the cable drum is in the range of 6:1 to 8:1.

The cable drum also comprises brake means for controlling and braking the rotation of the cable drum. The brake means can comprise at least one band brake mechanism disposed at one end of the cable drum, as well known to those skilled in the art. In a further embodiment, there is a band brake mechanism on each end of the cable drum. A mechanism controlling the brake bands is used to release the bands from the brake drums. The brake control mechanism can be activated to allow the cable drum to rotate. The mechanism is released or deactivated in order for the brake bands to engage the brake drums. In one embodiment, a pneumatically-operated air pot is used although other mechanisms may be used to operate the brake mechanism as well known to those skilled in the art. The use of band brakes, and their inherent nature to be self-actuating, provides a safe braking mechanism that offers superior protection against the cable drum entering into a runaway condition. While one embodiment uses band brakes, it should be apparent to one skilled in the art that other types of braking mechanisms may be used to control the brake drum rotation. These would include disc brakes and drum brakes among others.

The motor used in the present invention may be an electric motor, an internal combustion motor or a hydraulic motor. In one specific embodiment, a 3-phase AC electric motor is used. The motor is coupled to a motor control means for controlling the operation of the motor. A variable frequency drive motor controller mechanism can be used to control the operation of the motor although other control means may be used as well known to those skilled in the art. The motor control means is used to control the rotation direction and rotational speed of the motor so that the motor can operate the cable drum to either reel in or pay out a cable attached to the cable drum. The cable is fed to a pulley mounted on top of a drilling rig and then downward within the rig to a traveling block which is raised or lowered when the cable drum reels in or pays out the cable.

It is an aspect of the present invention to provide a cable drawworks that is compact in size so that it can be mounted on the drilling rig floor.

It is another aspect of the present invention to provide a cable drawworks that does not require a clutch mechanism to couple power from a motor to the cable drum.

It is another aspect of the present invention to provide a cable drawworks that does not require a liquid cooling system for the braking mechanism for the drawworks.

It is yet another aspect of the present invention to provide a cable drawworks that is simpler in design and operation than the prior art.

Broadly stated, one embodiment of the present invention includes a cable drawworks for a drilling rig, comprising a frame adapted for mounting on a drilling rig, the frame having a floor member and two opposing sidewall members; motor means for operating a cable drum mounted on said frame, said motor means having a drive shaft; a drum shaft having first and second ends, each of said ends rotatably mounted on a sidewall of said frame; said drum shaft having first and second ends; primary drive means for rotatably coupling said drive shaft to the first end of said drum shaft; a cable drum rotatably mounted on said drum shaft, said cable drum located between said first and second ends on said drum shaft; secondary drive means for rotatably coupling the second end of said drum shaft to said cable drum; brake means for braking the rotation of said cable drum; and motor control means for operating said motor means whereby said drawworks is capable of reeling in or paying out a cable attached to said cable drum.

DETAILED DESCRIPTION OF EMBODIMENTS

Figure 1:
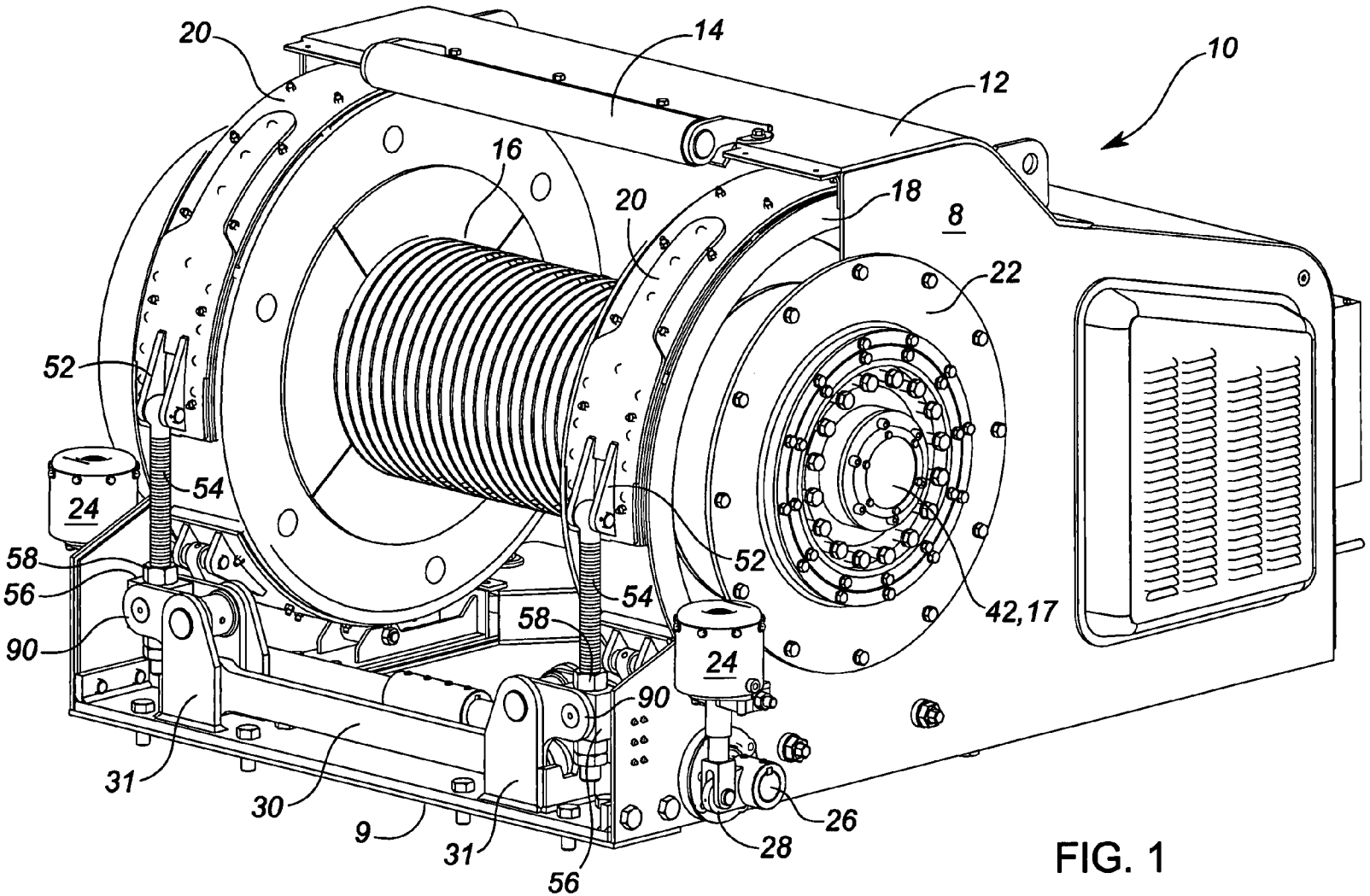
FIG. 1 is a perspective cutaway view of the front of a drawworks mechanism in accordance with one embodiment of the present invention.
Figure 2:
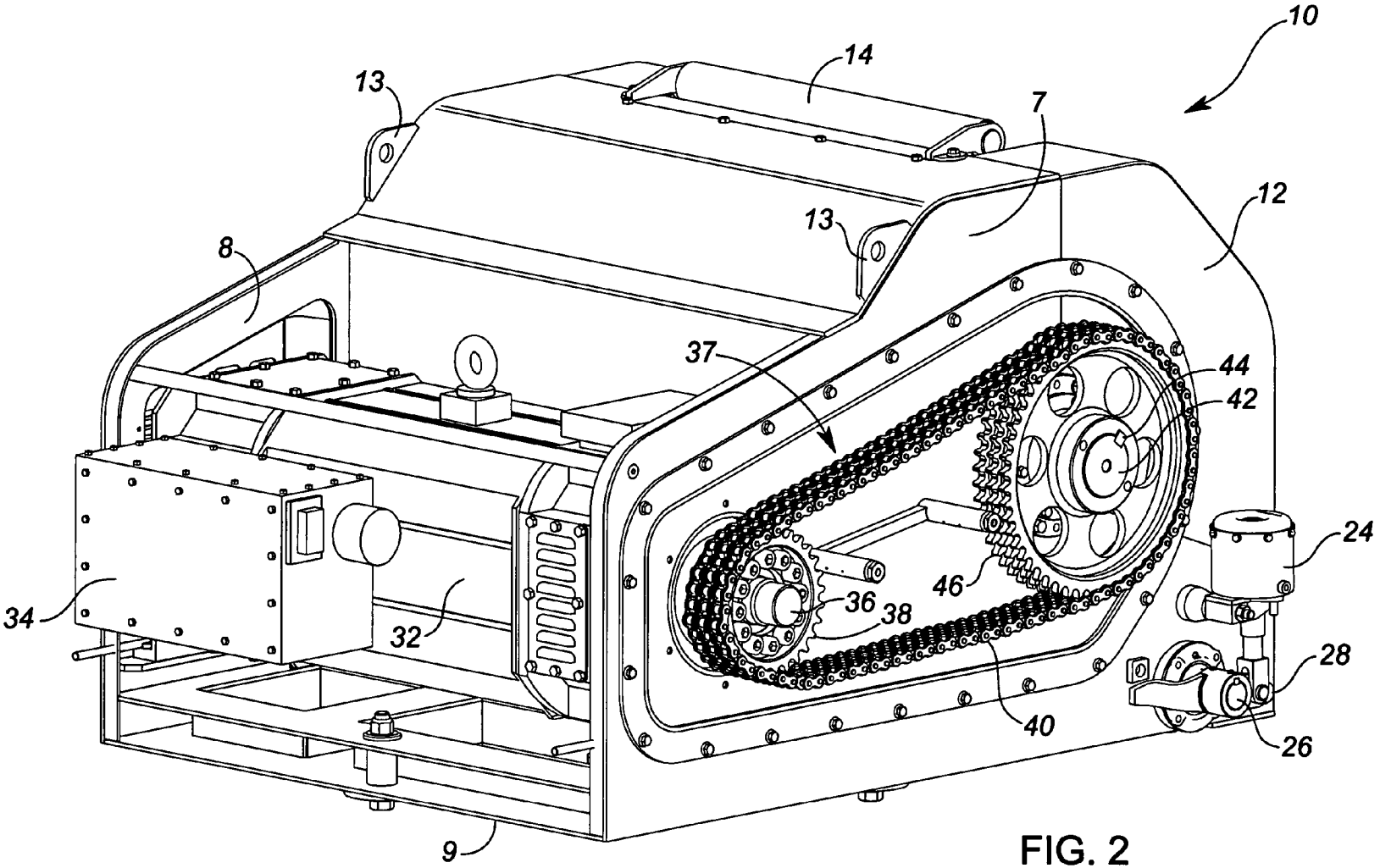
FIG. 2 is a perspective cutaway view of the rear of the drawworks mechanism of FIG. 1.
Figure 3:
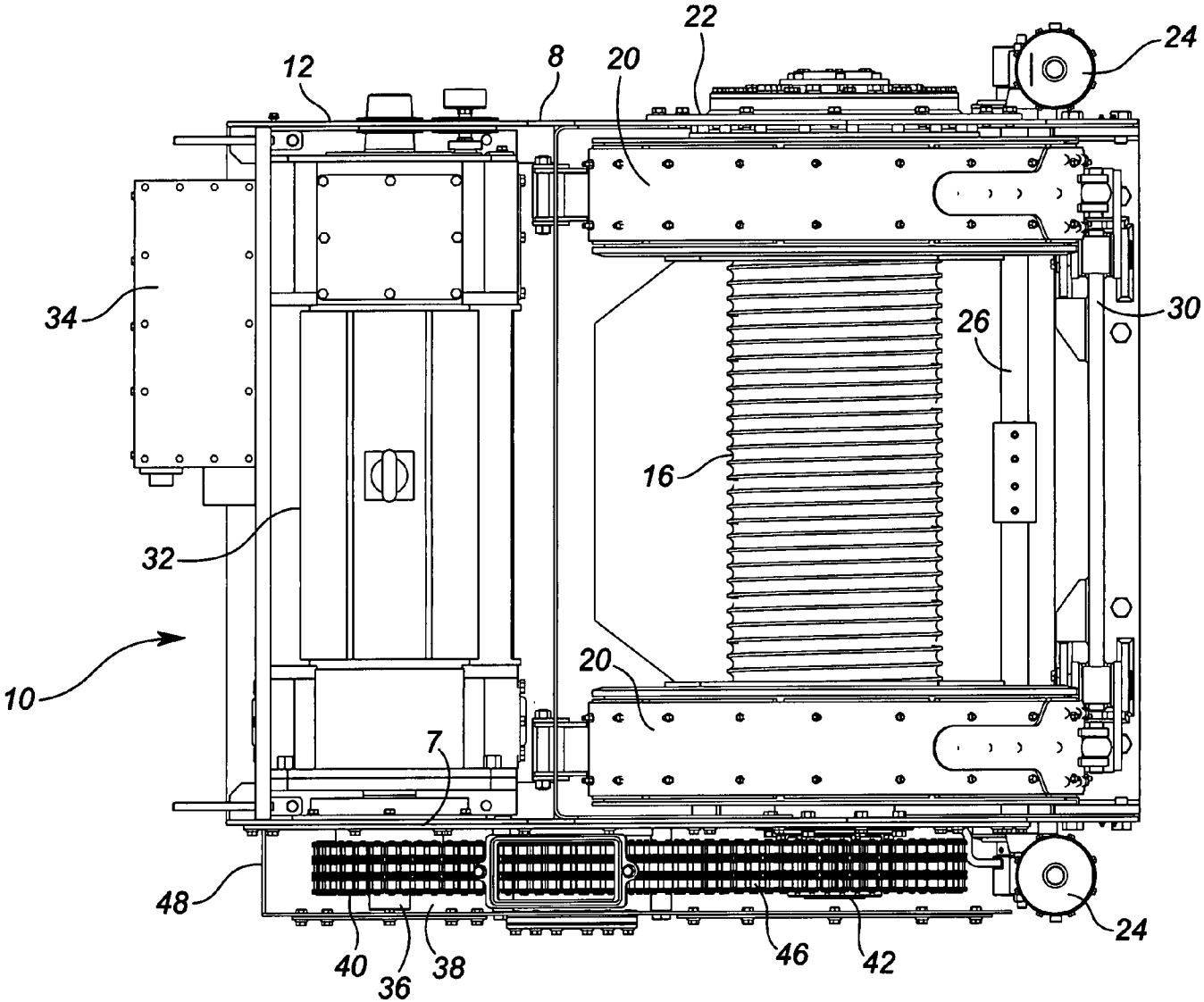
FIG. 3 is a top plan cutaway view of the drawworks mechanism of FIG. 1.

Referring to FIGS. 1 to 5, one embodiment of a drawworks mechanism (sometimes herein referred to as "drawworks" or "cable drawworks") in accordance with the teachings of the present invention is shown. Drawworks 10 comprises of frame 12 having floor 9, right sidewall 8 and left sidewall 7. Motor 32 is mounted on floor 9. Motor 32 can comprise a three-phase AC electric motor such as manufactured by Oilfield-Electric-Marine Inc. of Houston, Tex., U.S.A., Model No. TT600 series, although other types of similar power capability may be used. In one embodiment, motor 32 operates at 600 volts AC and produces up to 5,000 ft.-lb. of torque. Drawworks 10 can have approximate overall dimensions of 69" wide by 86" long by 50" tall. These dimensions permit drawworks 10 to be mounted on a drilling rig floor instead of being situated in a location near the drilling rig thereby reducing the physical space required for drilling operations.

Motor 32 has a motor shaft 36 whose longitudinal axis is generally horizontal when motor 32 is mounted on frame 12. Motor 32 is controlled by motor controller 34. Motor controller 34 controls the direction and rotational speed of motor 32. Motor controller 34 may be any type of 3-phase AC motor controller but in one specific embodiment can comprise a variable frequency drive motor controller. Motor controller 34 can be manufactured by Oilfield-Electric-Marine Inc. of Houston, Tex., U.S.A. and can be designed to operate with their TT600 series of AC electric motors.

Figure 4:
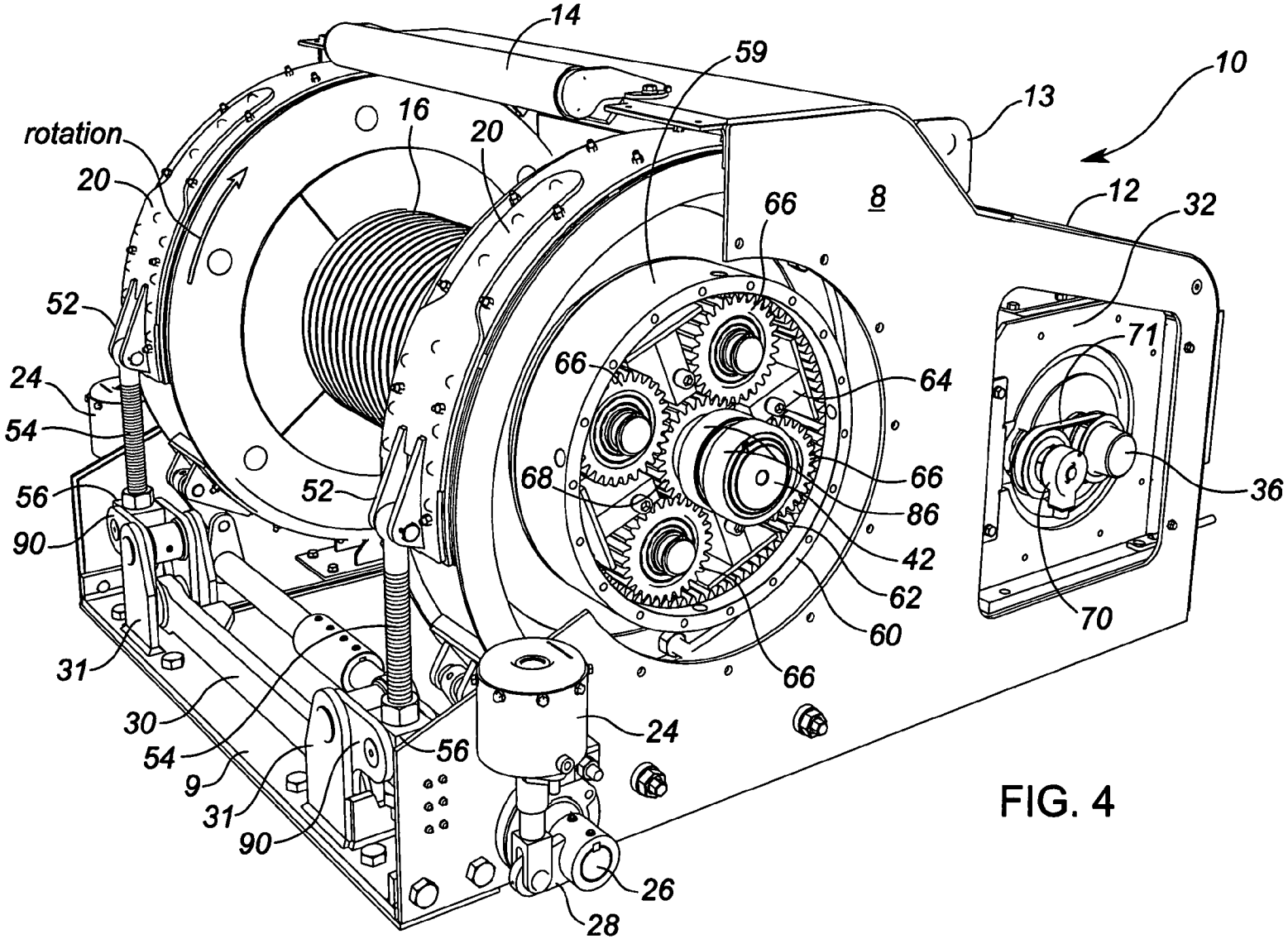
FIG. 4 is a perspective cutaway view of the front of the drawworks mechanism of FIG. 1 revealing the planetary gear transmission.
Figure 5:
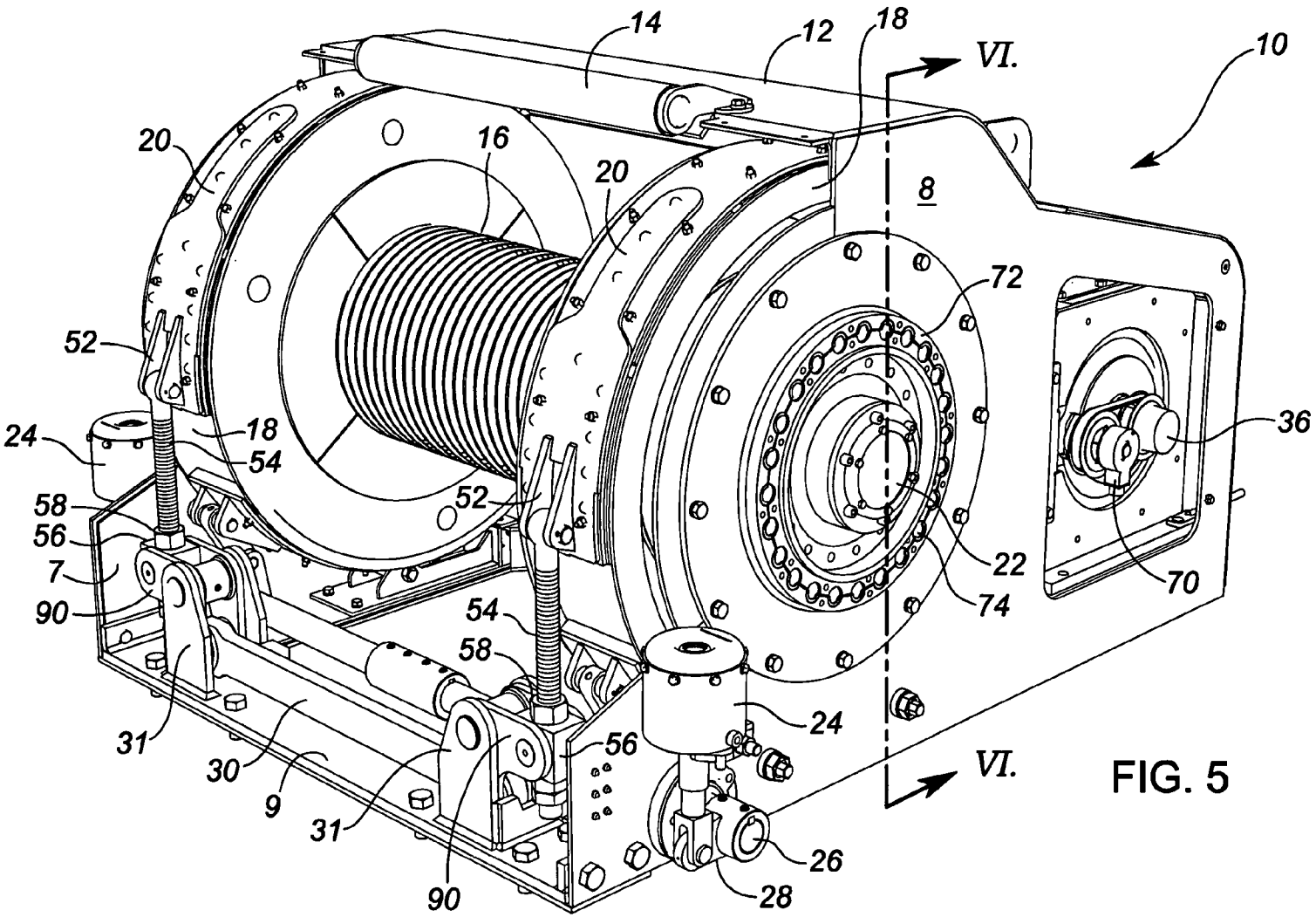
FIG. 5 is a perspective view of the front of the drawworks mechanism of FIG. 1 illustrating the planetary gear transmission attached to the frame of the present invention.

Referring to FIG. 4, motor shaft 36 is coupled to encoder 70 by belt 71. Encoder 70 is used to provide information to motor controller 34 such as motor speed, in revolutions per minute, and motor direction. Encoder 70 can be provided as model HS35 as manufactured by BEI Technologies Inc. of Goleta, Calif., U.S.A. An additional encoder (not shown) might also be operatively coupled to cable drum 16. These encoders provide information to motor controller 34 that enables drawworks 10 to operate in a number of modes. These include automated drilling operations, hoisting up or down operations, and emergency stopping operations.

Figure 6:
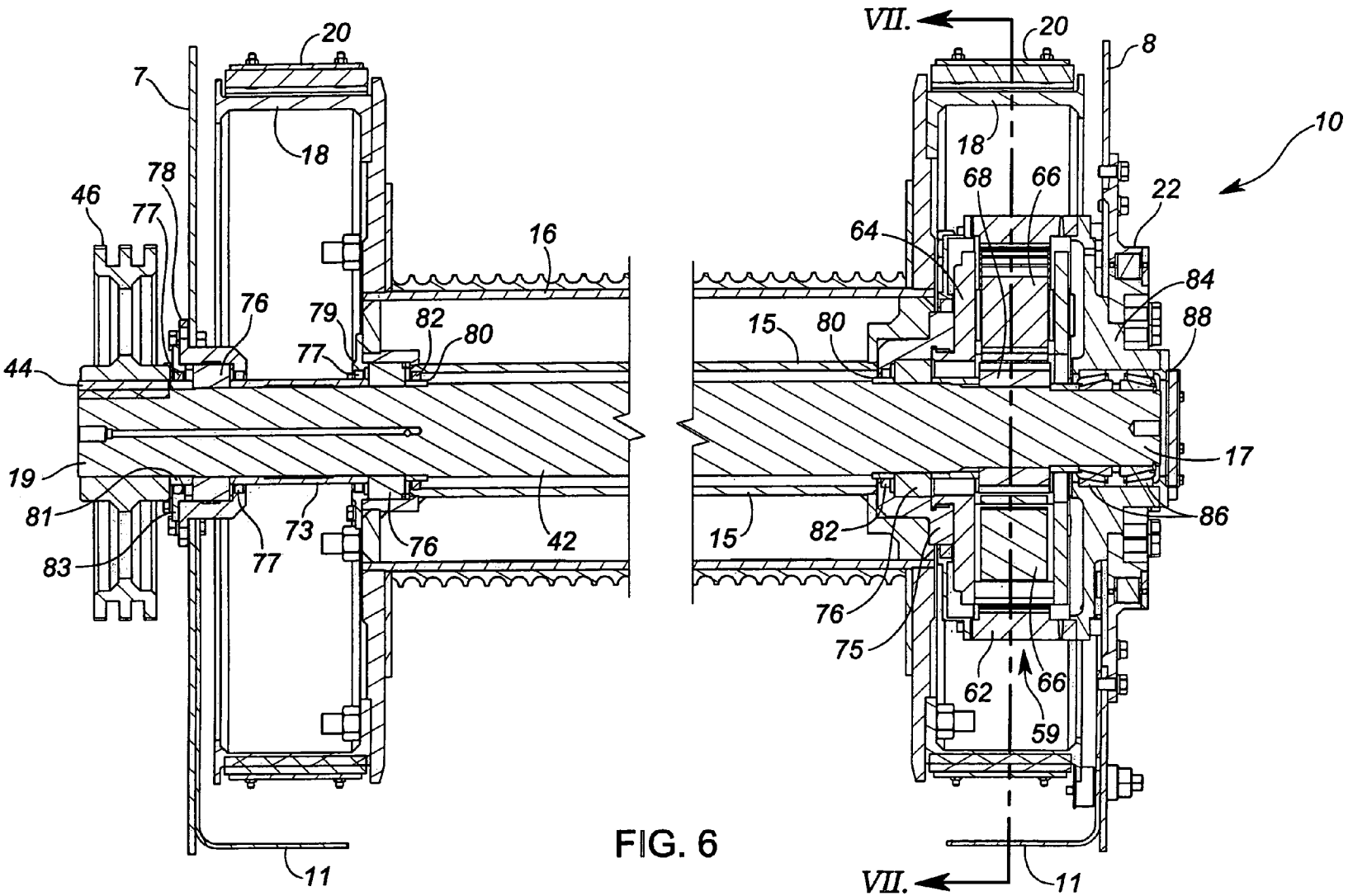
FIG. 6 is a cross-sectional view of the drawworks mechanism taken along section lines A-A in FIG. 5.

Rotatably mounted on frame 12 between sidewalls 7 and 8 is drum shaft 42 that has right end 17 and left end 19. Preferably, drumshaft 42 is positioned such that it is generally parallel to motor shaft 36. Cable drum 16 is rotatably mounted on drum shaft 42 between right end 17 and left end 19 via roller bearings 76 as shown in FIG. 6. This configuration allows cable drum 16 to rotate on drum shaft 42.

Primary drive 37 couples motor shaft 36 to left end 19 of drum shaft 42. In one embodiment, primary drive 37 comprises drive sprocket 38 mounted on motor shaft 36, sprocket 46 mounted on left end 19 of drum shaft 42 and chain 40 coupling drive sprocket 38 to sprocket 46. In this embodiment, chain 40 is a triple row or triplex chain and sprockets 38 and 46 are triplex chain sprockets. Primary drive 37 is covered by primary drive cover 48. Cover 48 has inspection points 49 and 50 to permit the visual inspection of chain 40. It should be appreciated by those skilled in the art that other means may be used in the primary drive transmission such as a primary drive belt and sprockets or intermeshed gears. In one embodiment of the present invention, primary drive 37 provides a primary gear reduction from motor 32 to drum shaft 42. The gear reduction ratio is in the range of 1.5:1 to 2:1. In one embodiment of the present invention, drive sprocket 38 has 28 teeth and sprocket 46 has 52 teeth resulting in a gear reduction ratio of 1.86:1.

Figure 7:
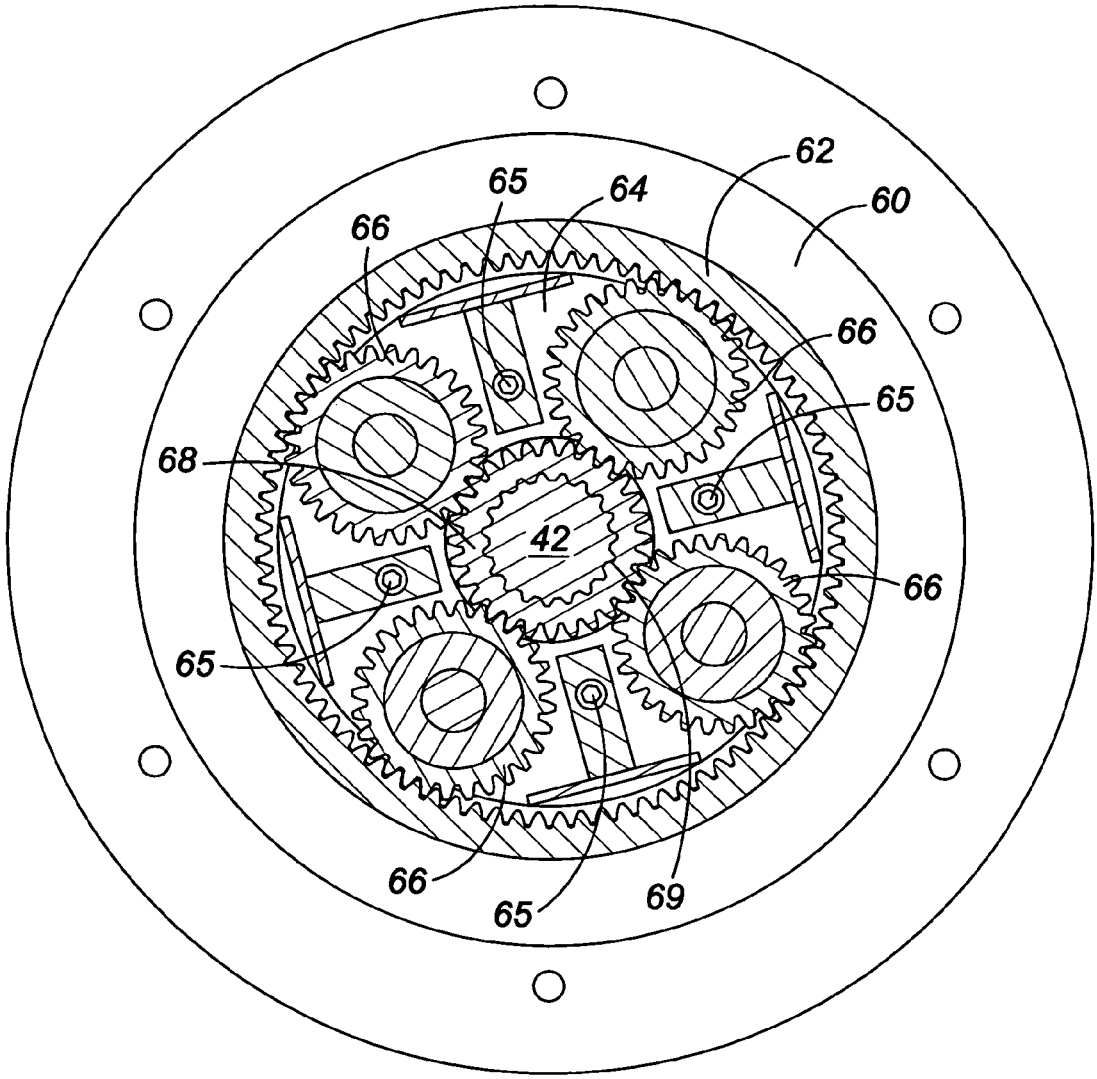
FIG. 7 is a cross-sectional end elevational view of the planetary gear transmission taken along section lines B-B in FIG. 6.
Figure 8:
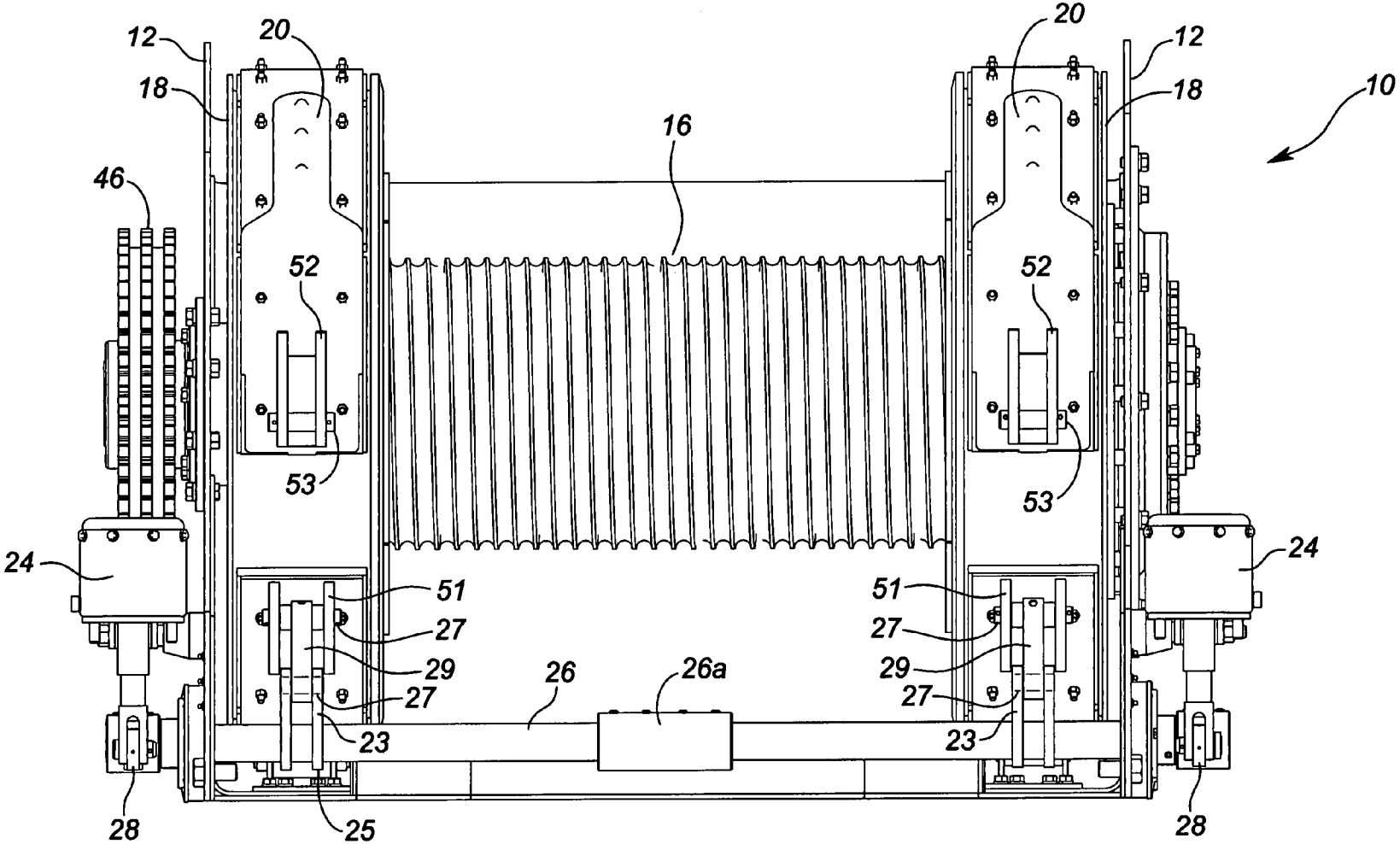
FIG. 8 is a front elevational view of the main brake shaft of the drawworks mechanism of FIG. 1.
Figure 9:
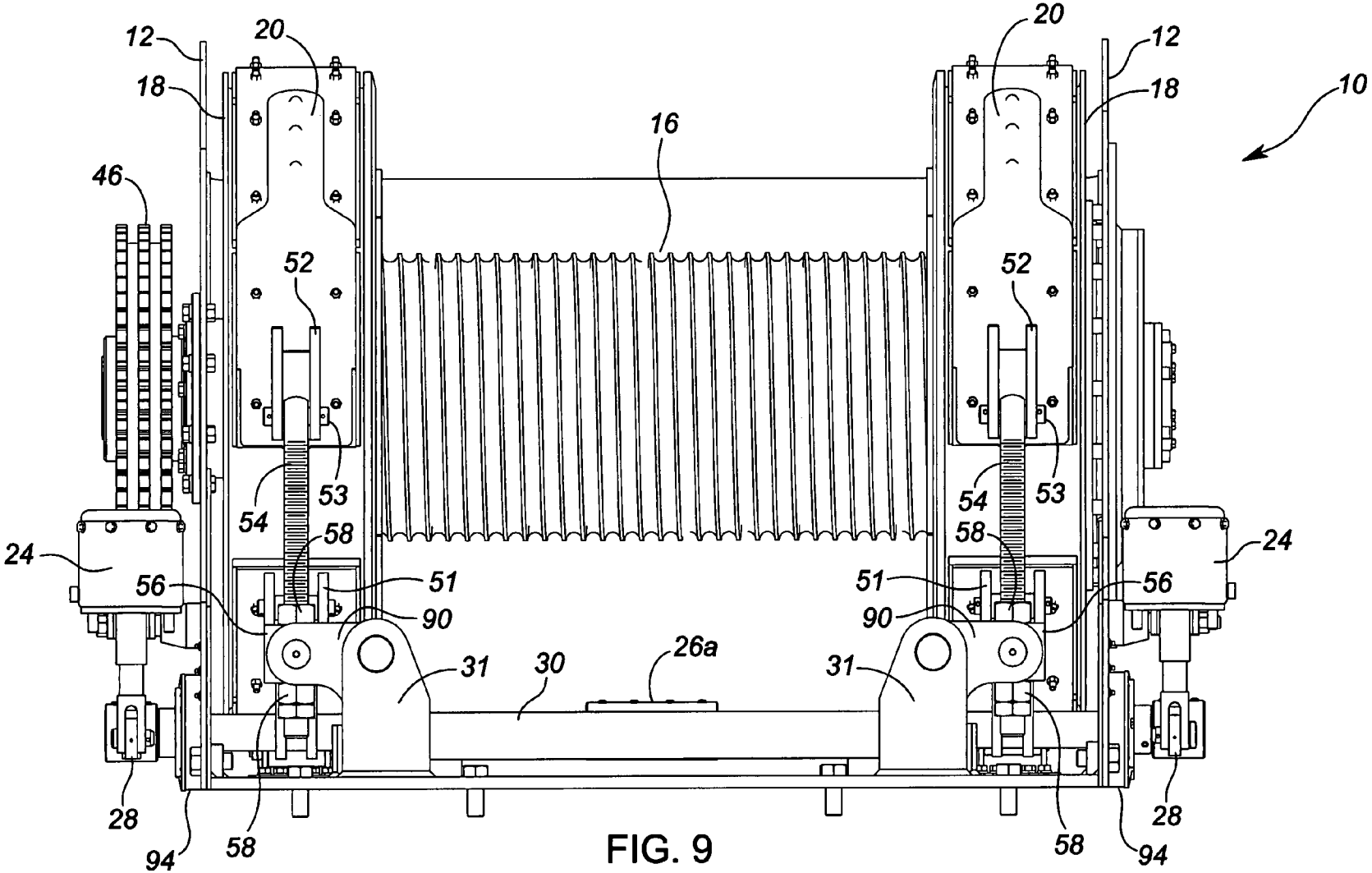
FIG. 9 is a front elevational view of the equalizer brake linkage of the drawworks mechanism of FIG. 1.

Referring to FIGS. 6 and 7, right end 17 of drum shaft 42 is coupled to cable drum 16 by secondary drive 59. Right end 17 of drum shaft 42 comprises a pair of tapered roller bearing sets 86 that are supported by bearing cover 88 and cover plate 22 that is bolted to right sidewall 8 of frame 12. Reinforcing plates 11 strengthen sidewalls 7 and 8 to support the rotation of cable drum 16 in frame 12 when drawworks 10 is being operated. Secondary drive 59 comprises ring gear housing 60 having ring gear 62 attached thereon, planetary gear sub-assembly 64 having four planetary gears 66 rotatably attached thereto and sun gear 68. Sun gear 68 is fitted to drum shaft 42. In the preferred embodiment, drum shaft 42 and sun gear 68 have intermeshing splines 69 whereby sun gear 68 is securely coupled to right end 17 of drum shaft 42.

Ring gear housing 60 is operatively coupled to right sidewall 8 of frame 12 via planetary gear cover 84 and cover plate 22. Planetary gear sub-assembly 64 is fastened to the end of cable drum 16 nearest right sidewall 8 via mounting bolts 65. Drum shaft 42 passes through roller bearing 76, seal 82 and spacer 80 which are all supported by bearing housing 75 which, in turn, is fastened to the right-hand side of cable drum 16 and hub 15. On the left-hand side of cable drum 16, drum shaft passes through spacer 80, seal 82 and roller bearing 76 which are secured to the left-hand side of cable drum 16 and hub 15 by cover plate 79. Drum shaft 42 then passes through spacer 73 before passing through seal 77 and roller bearing 76 which are supported by bearing housing 78 and secured by cover plate 83. Bearing housing 78 is fastened to sidewall 7 of frame 12. Drum shaft 42 then passes through spacer 81 and seal 77. Left-hand end 17 of shaft 42 then is coupled to sprocket 46 by key 44.

In operation, as motor 32 rotates drum shaft 42 via primary drive 37, sun gear 68 rotates planetary gear sub-assembly 64 thereby turning cable drum 16. In the one embodiment, sun gear 68 and planetary gear 66 each have 28 teeth. Ring gear 62 has 112 teeth thereby resulting in a secondary gear reduction ratio of 4:1. Combined with the gear reduction provided by primary drive 37, the overall gear reduction from motor 32 to cable drum 16 is in the range of 6:1 to 8:1. In one specific embodiment, the overall gear reduction ratio is 7.43:1. A cable (not shown) is attached to cable drum 16 and passes over roller 14 before ascending to cable pulleys mounted on top of a drilling rig (not shown). The cable is reeled in or paid out to raise or lower a traveling block within the drilling rig by operating the controls (not shown) of motor controller 34.

Referring to FIGS. 1 to 9, the braking mechanism of the present invention is shown. Attached to each end of cable drum 16 are brake drums 18. Surrounding each brake drum 18 are brake bands 20. Each brake band 20 has a "live end" and a "dead end". Each live end has a lug 51 affixed to brake band 20. Link 29 is attached to lug 51 at one end via pin 27. The other end of link 29 is pivotally attached to brake shaft crank 23 via pin 27. Brake shaft cranks 23 are attached to main brake shaft 26 which is rotatably mounted on frame 12 substantially parallel to the axis of cable drum 16. Main brake shaft 26 may be made into two sections having coupling 26A joining the two sections together into a single shaft. Each end of main brake shaft 26 passes through a sidewall (e.g., 8) of frame 12, such as through flange bearings 94, to permit rotation of main brake shaft 26. On each end of main brake shaft 26 are actuator cranks 28. Attached to each actuator crank 28 is a brake actuator 24. In one embodiment, brake actuators 24 are spring-loaded, pneumatically-operated devices coupled to pneumatic control lines (not shown) such as Maxibrake® model no. MA15623 as manufactured by Haldex Commercial Vehicle Systems of Kansas City, Mo., U.S.A. It should be appreciated by those skilled in the art, however, that other types of mechanisms may be used to operate main brake shaft.

The dead end of each brake band 20 has a dead end lug 52 mounted thereon. Equalizer rods 54 are pivotally attached at one end to each dead end lug 52 via pins 53. The other ends of equalizer rods 54 pass through pivot blocks 56. Equalizer rods 54 are threaded and are secured to pivot blocks 56 with lock nuts 58. Each pivot block 56 is pivotally attached to an L-shaped equalizer link 90 that is, in turn, pivotally attached to equalizer lugs welded to floor 9 of frame 12. Equalizer bar 30 is pivotally attached at each end to an equalizer link 90.

In operation, brake actuators 24 are activated or pressurized to turn brake shaft 26 thereby loosening tension on brake bands 20 so that cable drum 16 may turn freely. When braking is to be applied to cable drum 16, brake actuators 24 are relieved of their pressure allowing the internal spring of the actuators to cause actuators 24 to operate actuator cranks 28 and rotate brake shaft 26 thereby causing brake bands 20 to tighten around brake drums 18. As brake bands 20 contact brake drums 18, the frictional forces on brake bands 20 cause equalizer rods 92 to pull up on pivot blocks 56. The mechanical relationship caused by equalizer bar 30 connected to equalizer links 90 results in an automatic equalization of the braking forces on brake drums 18 so that each brake drum 18 experiences the same braking force. This prevents cable drum 16 from twisting along its axis during braking conditions.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the clams that follow.

I claim:

1. A cable drawworks for a drilling rig, comprising:

(a) a frame adapted for mounting on a drilling rig, the frame having a floor member and two opposing sidewall members;

(b) motor means for operating a cable drum mounted on said frame, said motor means having a drive shaft;

(c) a drum shaft having first and second ends, each of said ends rotatably mounted on a sidewall of said frame;

(d) primary drive means for rotatably coupling said drive shaft to the first end of said drum shaft;

(e) said cable drum rotatably mounted on said drum shaft, said cable drum located between said first and second ends on said drum shaft;

(f) secondary drive means for rotatably coupling the second end of said drum shaft to said cable drum;

(g) brake means for braking the rotation of said cable drum, wherein said brake means comprises at least one band brake capable of braking said cable drum; and (h) motor control means for operating said motor means whereby said drawworks is capable of reeling in or paying out a cable attached to said cable drum.

2. The cable drawworks as set forth in claim 1 wherein said drive shaft is substantially horizontal.

3. The cable drawworks as set forth in claim 2 wherein said drum shaft is substantially parallel to said drive shaft.

4. The cable drawworks as set forth in claim 1 wherein said motor means comprises an alternating current ("AC") electric motor.

5. The cable drawworks as set forth in claim 4 wherein said AC electric motor is a 3 -phase AC electric motor.

6. The cable drawworks as set forth in claim 4 wherein said motor control means comprises a variable frequency drive controller adapted to control the operation of said AC electric motor.

7. The cable drawworks as set forth in claim 1 wherein said primary drive means comprises a roller chain and a pair of sprockets operatively attached to each of said drive shaft and the first end of said drum shaft.

8. The cable drawworks as set forth in claim 1 wherein said primary drive means comprises a drive belt and a pair of drive pulleys operatively attached to each of said drive shaft and the first end of said drum shaft.

9. The cable drawworks as set forth in claim 1 wherein said primary drive means comprises at least a pair of intermeshing gears operatively attached to each of said drive shaft and the first end of said drum shaft.

10. The cable drawworks as set forth in claim 1 wherein said secondary drive means comprises a planetary gear transmission having a ring gear, a sun gear and a planetary gear set.

11. The cable drawworks as set forth in claim 10 wherein said sun gear is operatively attached to the second end of said drum shaft and said planetary gear set is operatively attached to said cable drum.

12. The cable drawworks as set forth in claim 1 wherein said brake means comprises a pair of band brakes, the band brakes capable of braking said cable drum, each band brake operatively coupled to an end of said cable drum.

* * * * *